US009122246B2

(12) United States Patent
Capt

(10) Patent No.: US 9,122,246 B2
(45) Date of Patent: Sep. 1, 2015

(54) MECHANISM FOR SECURING A BALANCE SPRING STUD TO A BALANCE BRIDGE AND SPRUNG BALANCE REGULATING DEVICE INCLUDING SUCH A MECHANISM

(71) Applicant: Blancpain SA, Le Brassus (CH)

(72) Inventor: Edmond Capt, Le Brassus (CH)

(73) Assignee: Blancpain SA, Le Brassus (CH)

( * ) Notice: Subject to any disclaimer, the term of this patent is extended or adjusted under 35 U.S.C. 154(b) by 0 days.

(21) Appl. No.: 14/540,160

(22) Filed: Nov. 13, 2014

(65) Prior Publication Data

US 2015/0177689 A1 Jun. 25, 2015

(30) Foreign Application Priority Data

Dec. 20, 2013 (EP) ..... 13199179

(51) Int. Cl.
*G04B 18/06* (2006.01)
*G04B 15/14* (2006.01)
*G04B 17/32* (2006.01)

(52) U.S. Cl.
CPC ..... *G04B 15/14* (2013.01); *G04B 17/32* (2013.01); *G04B 18/06* (2013.01)

(58) Field of Classification Search
CPC ..... G04B 17/32; G04B 18/06; G04B 17/325; G04B 18/08; G04B 17/063
USPC ..... 368/169–170, 176–178
See application file for complete search history.

(56) References Cited

U.S. PATENT DOCUMENTS 1,311,501 A * 7/1919 Ecaubert ..... 368/178
3,120,097 A * 2/1964 Dickerman ..... 368/174
3,395,532 A * 8/1968 Schneider ..... 368/176
4,201,042 A * 5/1980 Visconti et al. ..... 368/170
7,059,764 B2 * 6/2006 Hintze et al. ..... 368/127
7,237,945 B2 * 7/2007 Geyer ..... 368/178
2012/0008467 A1 * 1/2012 Helfer et al. ..... 368/171
2013/0064046 A1 3/2013 Rochat
2014/0341001 A1 * 11/2014 Cordier ..... 368/131

FOREIGN PATENT DOCUMENTS

CH 76 336 12/1917
CH 347 769 7/1960
EP 2 570 871 A1 3/2013

OTHER PUBLICATIONS

European Search Report issued Jul. 31, 2014 in European application 13199179, filed on Dec. 20, 2013 ( with English Translation).

* cited by examiner

*Primary Examiner* — Sean Kayes
(74) *Attorney, Agent, or Firm* — Oblon, McClelland, Maier & Neustadt, L.L.P.

(57) ABSTRACT

The regulating device includes an inertial balance (7) including a balance staff arranged to be pivotally mounted in the timepiece, a balance bridge (9) and a bearing (11) carried by the balance bridge and arranged to hold one end of the balance staff, a balance spring (1) including an inner end integral with the balance and an outer end (1*a*) integral with a stud (3; 103), and a mechanism for securing the stud (3; 103) including a housing (17) for receiving the stud and which is formed in a stud holder (5) pivoted on the balance bridge (9), the securing mechanism further including an elastic arm (15; 115) arranged to pivot concentrically to the balance staff between a first position where the elastic arm immobilizes the stud (3; 103) and a second position where the elastic arm is disengaged from the stud to allow the stud to be inserted into or removed from the housing.

14 Claims, 2 Drawing Sheets

MECHANISM FOR SECURING A BALANCE SPRING STUD TO A BALANCE BRIDGE AND SPRUNG BALANCE REGULATING DEVICE INCLUDING SUCH A MECHANISM

This application claims priority from European Patent Application No. 13199179.6 filed 20.12.2013, the entire disclosure of which is incorporated herein by reference.

FIELD OF THE INVENTION

The present invention concerns a regulating device for a timepiece including an inertial balance including a balance staff arranged to be pivotally mounted in the timepiece, a balance bridge carrying a bearing arranged to hold one end of the balance staff, a balance spring including an inner end integral with the balance and an outer end integral with a balance-spring stud, hereinafter "stud", and finally a mechanism for securing the stud including a housing carried by the balance bridge and arranged to receive the stud whilst allowing the position thereof to be longitudinally adjusted, the securing mechanism further including an elastic arm arranged to bear laterally on the stud so as to immobilise the stud against a wall of the housing.

PRIOR ART

There are known regulating members including a balance and a balance spring whose inner end is rigidly fixed to a collet driven onto the balance staff, and whose outer end is rigidly fixed to a stud carried by a stud holder which is axially movable concentrically to the balance staff.

There are several known methods of attaching the outer end of the balance spring to a stud. One of these methods is illustrated in FIGS. 1 and 2 annexed hereto. First of all, the end of the balance spring (referenced 101) is inserted into a notch or a hole in the stud 103. Then the balance spring is locked in the notch or hole by adhesive bonding. Stud 103 is then itself inserted into a housing arranged in stud holder 105. A small screw 107 is then provided for immobilising the stud once the height thereof inside the housing has been adjusted.

The stud holder is pivoted with a tight fit in one portion of the balance cock (or balance bridge) concentric to the balance staff. As a result of this characteristic, a watchmaker can adjust the angular position of the stud and of the outer end of the balance spring simply by pivoting the stud holder with respect to the balance. This manipulation is important because the angular position of the outer end of the balance spring must be such that the impulse pin is aligned in the pallet lever-balance axis when the balance is in its position of equilibrium.

The adjustment of the position of the balance spring with respect to the balance staff must be precise. Indeed, if the balance spring is off-centre or out of square with respect to the balance staff, this causes significant chronometric defects, in particular as regards the isochronism of the regulating member. The stud must therefore be perpendicular to the plane of the balance spring and positioned precisely to guarantee concentric development of the balance spring. In practice, it is difficult to adjust the position of the stud, since access is restricted and the parts concerned are of very small dimensions. With conventional balance springs made of metallic alloys, once the outer end of the balance spring is attached to the balance bridge by the stud and the stud holder, any residual deviations from the ideal three-dimensional shape of the balance spring can still be corrected by plastic deformation of the end of the balance spring.

If the balance spring is made of a brittle material, such as silicon, diamond or quartz, such adjustment by plastic deformation is not possible. In these conditions, the use of a stud requires very tight manufacturing tolerances and a robust stud-balance spring assembly, so as to obtain the most perfect perpendicularity possible between the axis of the stud and the plane of the balance spring. There is no difficulty in understanding that this requirement represents a major difficulty on the industrial scale, given that the simple fact of immobilising the stud in its housing by tightening a screw may be sufficient to distort the orientation of the stud. Further, the tightening screw is frequently dropped and lost during the adjustment operation.

In accordance with the foregoing, it is an object of the present invention to provide a mechanism for securing a stud, which offers the possibility of adjusting the position of the stud relative to the balance bridge and subsequently immobilising the stud more easily without using a screw. Swiss Patent CH 76336 discloses a sprung balance regulating device which includes a mechanism for securing the stud and which conforms to the definition given in the introduction. According to that document, the balance bridge bears a top balance-endpiece which has a lug provided with a lateral notch acting as a housing for the stud. Once the stud is inserted into the housing, it is held in place by a spring attached to the balance bridge. The spring acts by pressing the stud against the bottom of the notch so as to immobilise it. An eccentric screw head is also provided to move the spring away from the stud and release it. This known solution has certain drawbacks. In particular, since the top balance-endpiece is rigidly mounted on the balance bridge, the orientation of its lug cannot be changed. The position of the housing provided for receiving the stud is therefore permanently fixed. Thus, it is another object of the present invention to provide a sprung balance regulating device which also allows for adjustment of the position of the housing in which the stud is housed.

BRIEF SUMMARY OF THE INVENTION

The present invention achieves this object by providing a regulator for a timepiece conforming to the annexed claim 1.

As a result of these characteristics, a watchmaker can easily secure the stud to the stud holder without using a screw, and moreover, has the possibility of adjusting the angular position of the stud and of the outer end of the balance spring simply by pivoting the stud holder with respect to the balance, just as simply as if the stud were attached by a screw. Indeed, according to the invention, the elastic arm can be rotated with respect to the balance bridge and with respect to the stud holder. It is thus possible, in particular, to pivot the elastic arm and the stud holder together.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF ONE EMBODIMENT

In the following description, the indications "top" and "bottom" refers to the cross-sectional view of FIG. 2. The bottom is the balance spring side. Further, the indication "turned outwards" is to be understood as meaning facing the opposite direction to the balance staff.

Figure 1:
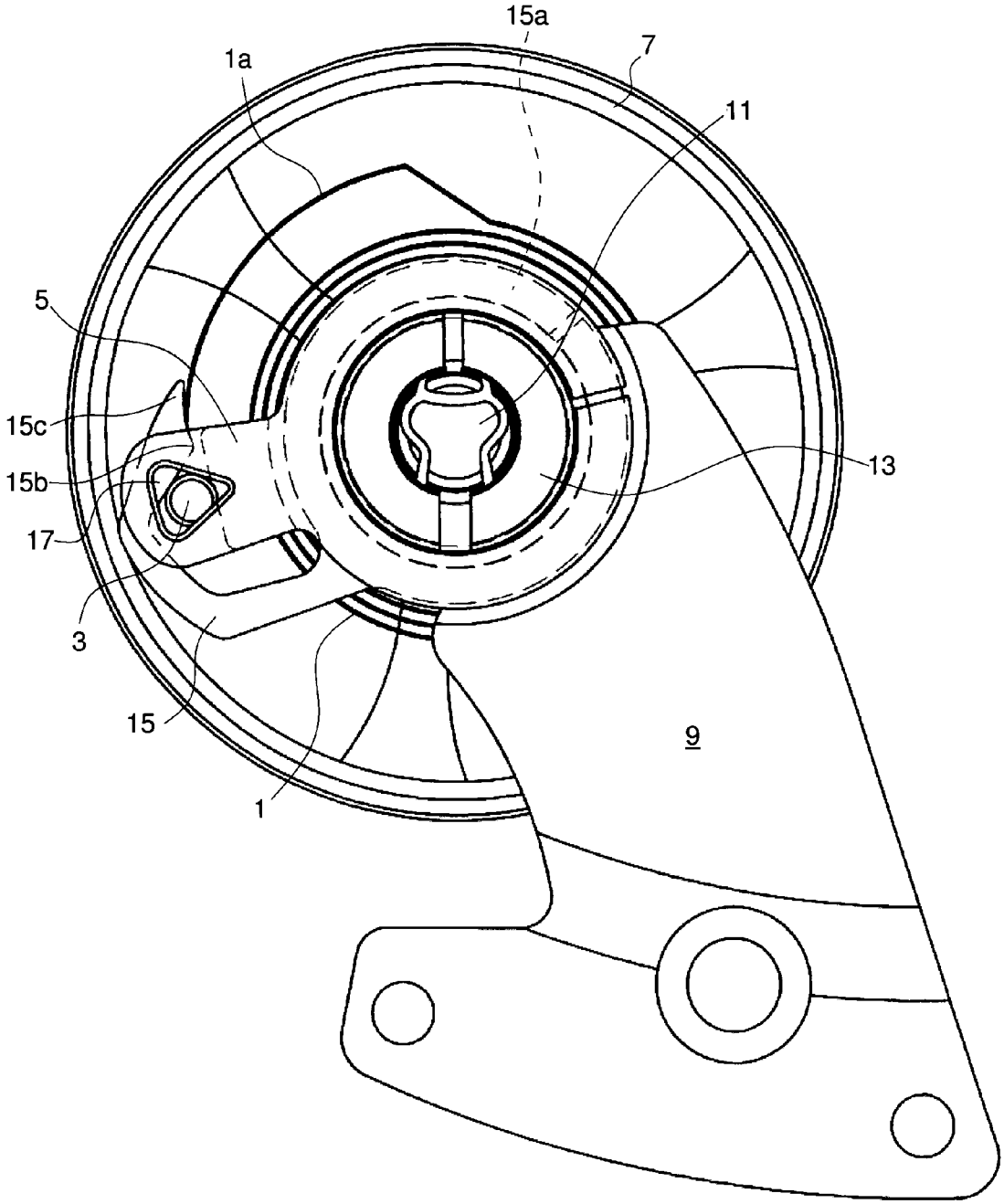
FIG. 1 is a plan top view of sprung balance regulating member according to a particular embodiment of the invention.

The Figures show a sprung balance regulating member for a timepiece corresponding to a particular embodiment of the invention. FIG. 1 shows the balance 7 whose staff is pivoted between two bearings. In a conventional manner, one of these bearings (referenced 11) is carried by the balance bridge (or cock) 9 via a top balance-endpiece 13, whereas the other bearing is mounted in the main plate (not shown). Also in a conventional manner, the balance is associated with a balance spring 1 whose central end is attached to the balance staff.

Cock 9 also serves as a support for an assembly formed by a stud 3, a stud holder 5 and an elastic arm 15. This assembly is intended to position the outer end 1*a* of balance spring 1. In the present example, end 1*a* is first of all rigidly secured to the stud by adhesive bonding. To accomplish this, the end of the balance spring is first inserted into a notch in the stud (not referenced but visible in FIG. 2). The balance spring is then locked in the notch by adhesive bonding. It is specified that the invention is not limited to a particular method of securing the end 1*a* of the balance spring to the stud. End 1*a* could, equally, for example, be secured to a conventional stud with a pin. Or, according to another variant, it could be provided that stud 3 and balance spring 1 are formed integrally in a single piece.

In the present example, stud holder 5 is essentially formed of an annular portion concentric to the balance staff, and an extension-piece in the form of arms (hereafter termed "lugs") carried by stud 3 and which extends radially with respect to balance staff 7 towards the outer coils of the balance spring. In a conventional manner, the lug of stud holder 5 has a housing 17 oriented parallel to balance staff 7 and into which the stud is longitudinally inserted. Further, stud holder 5 is pivoted with a tight fit by the annular portion thereof on top balance-endpiece 13 which is concentrically to the balance. As a result of this characteristic, a watchmaker can modify the position of stud 3 simply by pivoting the stud holder 5 with respect to the cock and to the balance. It is also specified that the stud holder is preferably made of silicon, but it could also be made of another material. By way of example, the stud holder could be made of metal, or of a composite material. If the stud is made of metal, it is preferably formed by galvanic deposition by a LIGA technique.

Referring again to FIG. 1, it can be seen that housing 17 is formed by a through hole made in the lug of stud holder 5. It can be seen, in the illustrated example, that the through hole has a transverse section in the shape of an isosceles triangle; one of the vertices of the triangle points towards the balance staff. Referring now to FIG. 2, it can be seen that the housing 17 is oriented parallel to the balance staff. Further, stud holder 5 has a rim 19 which projects underneath the lower face of the lug. Referring to the Figure, it is clear that rim 19 has the shape of a groove which is disposed in the extension of the inner wall of housing 17. Rim 19 thus extends housing 17 in the form of a groove whose bottom faces towards the balance staff. Thus, the total length of housing 17, with the extension, is greater than the thickness of the stud holder lug. However, the transverse section of the extension of the housing is not triangular, but V-shaped. The opening of the groove is oriented towards the exterior of the balance.

Referring again to FIG. 1, it can be seen that the round shape of stud 3 prevents it from abutting against a vertex of the triangle (in other words, against the bottom of the groove). In the illustrated example, the stud is arranged to abut simultaneously against two faces of the inner wall of triangular housing 17. These two faces of the inner wall extend parallel to the balance staff and define together a groove whose bottom is oriented towards the balance staff. In the illustrated example, the two faces in contact with stud 3 form between them an angle of 60 degrees. It will be understood, however, that the invention is not limited to this particular value of the angle between the faces of the triangle. It will also be noted that, in the example illustrated in FIGS. 1 and 2, the shape of the stud 3 is essentially cylindrical. One advantage of the inherent rotational symmetry of the cylindrical shape is that the position of the stud relative to stud holder 5 can be adjusted, not only longitudinally, but also in rotation. This additional possibility may prove advantageous when the balance spring is made of a brittle material. Indeed, when the spring is made of such a material, it is in principle impossible to correct any deviation of the spring by plastically deforming the end thereof. However, in the case where the possibility of a rotational adjustment is unnecessary, it is advantageously possible to use a stud 103 having a flat portion (visible in FIGS. 3 and 4) arranged to cooperate with the inner wall of housing 13 so as to angularly lock the stud.

Figure 2:
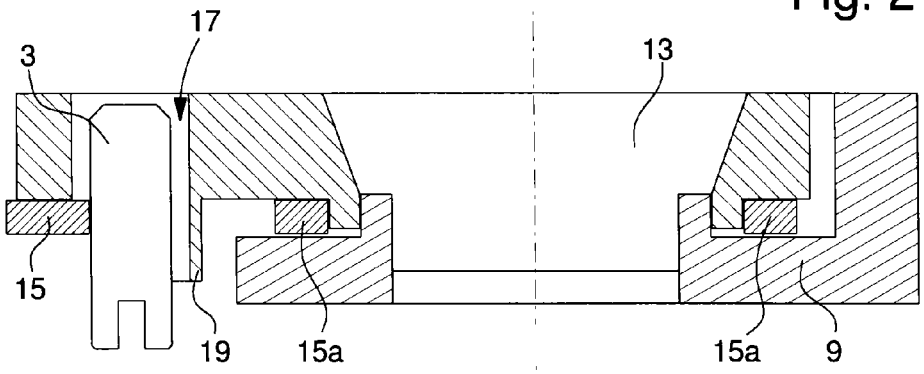
FIG. 2 is an enlarged cross-section along the line A-A of FIG. 1.

As already mentioned, FIGS. 1 and 2 also show an elastic arm 15 arranged to bear laterally on stud 3 so as to immobilise the stud against the wall of housing 17. According to the embodiment which is the subject of the present example, elastic arm 15 is pivoted on the lower surface of stud holder 5 via an annular portion 15*a* which is integral with elastic arm 15 and which is shown in dotted lines in FIG. 1. It is specified, however, that according to a variant, elastic arm 15 could equally be pivoted directly on cock 9 or top balance-endpiece 13. Referring again to FIGS. 1 and 2, it can be seen that elastic arm 15 is shown in a first angular position where it immobilises stud 3 by abutting laterally directly on the stud on rim 19, where housing 17 is extended in the form of an open groove.

As can be seen in FIG. 1, in the illustrated example, elastic arm 15 is bent so that its shape generally resembles that of a hook. Further, the end of the elastic arm has a jumper-spring profile with two substantially straight segments which define, at the junction between them, a vertex 15*b*. Vertex 15*b* is located in proximity to the pointed end 15*c* of the elastic arm. In the rest position (when the elastic arm is not stressed), the distance separating the point 15*c* from the balance staff is normally greater than the distance separating the axis of stud 3 from said balance staff. Conversely, the distance separating vertex 15*b* from the balance staff is preferably smaller than the distance between the axis of the stud and the balance staff.

Referring to FIG. 1, it can be seen that arm 15 is shown in a first position where it passes underneath the lug of stud holder 5 so as to by-pass stud 3 so that a distal portion of the arm including end 15*c* and vertex 15*b* are on the other side of the stud. It will be clear that when the elastic arm is in this first position, it bears on the outer side of stud 3 so that the latter is returned towards the balance staff. Further, it will also be understood that the reaction force of the stud on the elastic arm has a tangential component which has the effect of holding the elastic arm in the position shown in FIG. 1.

According to the invention, elastic arm 15 is arranged to be able to be pivoted with respect to stud holder 5. If a watchmaker forces the elastic arm to pivot relative to the stud holder in the anticlockwise direction, the end of the arm slides on stud 3 and is pushed back outwards. At the instant when vertex 15*b* slides over the stud, the tangential component of the reaction force exerted by the stud on the elastic arm changes direction and rapidly pivots elastic arm 15 until it is completely disengaged from stud 3. The stud can therefore very easily be released simply by moving elastic arm 15 from the first angular position illustrated in FIG. 1 to a second angular position, disengaged from the stud, simply by rotating the elastic arm in the anticlockwise direction.

Conversely, it is possible to move elastic arm 15 from the second angular position to the first by rotating it in the clockwise direction. Since the distance separating point 15*c* from the balance staff is greater than the distance separating the axis of the stud 3 from said balance staff, when point 15*c* encounters stud 3, it slides over the surface thereof gradually moving away outwards. At the instant when vertex 15*b* slides over the stud, the tangential component of the force exerted by the elastic arm on the stud changes direction and rapidly pivots elastic arm 15 to the first angular position. The stud is then immobilised against the inner wall of its housing.

Figure 3A:
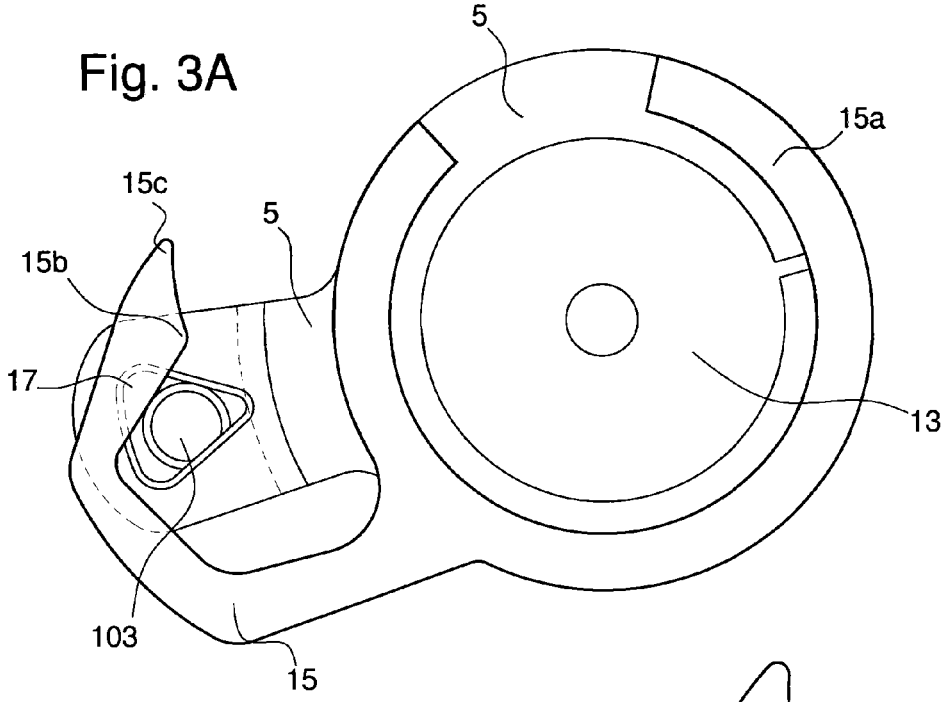
FIG. 3A is a partial plan bottom view of the regulating member of FIG. 1, which shows more particularly a second variant of the stud, and the stud holder and elastic arm.

FIGS. 3 and 4 show two variants of the embodiment which is the subject of the detailed description. The variant shown in FIG. 3A is practically identical to that shown in FIGS. 1 and 2. The elements shown in FIG. 3A which are identical to those of FIGS. 1 and 2 are designated by the same reference numerals. A comparison of FIGS. 1 and 3A reveals that, unlike stud 3 which was cylindrical, stud 103 seen in FIG. 3A has a flat portion. As already mentioned, the advantage of using a stud having a flat portion is that the stud can be angularly locked against one of the inner walls of housing 17.

Figure 3B:
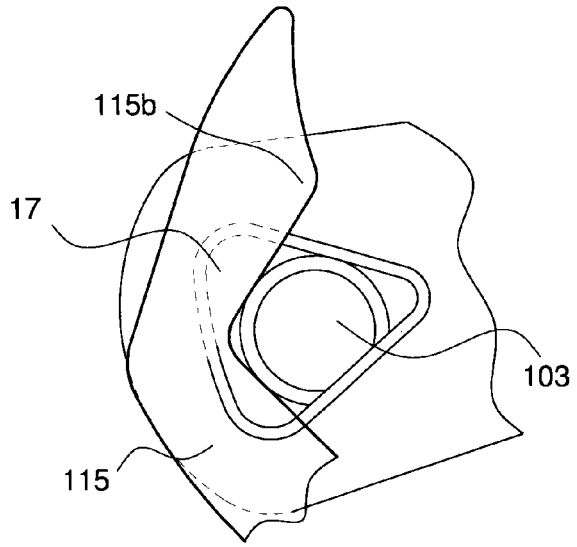
FIG. 3B is a partial view similar to FIG. 3A but showing a second variant of the elastic arm.

FIG. 3B is a partial view similar to FIG. 3A, but showing an elastic arm 115 corresponding to a second variant. According to this variant, the inner flank of elastic arm 115 also has, in proximity to vertex 115*b*, a V-shaped seat formed at the junction between two substantially straight segments. As will be understood with reference to FIG. 3B, the V-shaped seat locks stud 115 more securely. It will also be clear that various alterations and/or improvements evident to those skilled in the art may be made to the embodiment described herein without departing from the scope of the present invention defined by the annexed claims. In particular, the housing arranged in the stud holder does not need to be triangular. It may have any shape. In particular, it may be formed by a groove which is open over its entire length.

What is claimed is:

1. A regulating device for a timepiece including:

an inertial balance including a balance staff arranged to be pivotally mounted in the timepiece, a balance bridge and a bearing carried by the balance staff and arranged to hold one end of the balance staff, a balance spring including an inner end integral with the balance and an outer end integral with a stud;

a mechanism for securing the stud, the mechanism for securing the stud including a housing carried by the balance staff and arranged to receive the stud while allowing for the adjustment of the longitudinal position thereof, the securing mechanism further including an elastic arm arranged to bear laterally on the stud so as to immobilise the stud against a wall of the housing;

wherein the housing is formed in a stud holder pivoted on the balance bridge concentrically to the balance staff, and wherein the elastic arm is arranged to pivot concentrically to the balance staff, with respect to the balance bridge and with respect to the stud holder, between a first position where the elastic arm immobilises the stud and a second position where the elastic arm is disengaged from the stud so as to allow the stud to be inserted into or removed from the housing.

2. The regulating device according to claim 1, wherein the elastic arm is pivoted on the stud holder.

3. The regulating device according to claim 2, wherein the elastic arm is pivoted on the lower face of the stud holder.

4. The regulating device according to claim 2, wherein the elastic arm is pivoted on the stud holder via an annular portion integral with the elastic arm.

5. The regulating device according to claim 1, wherein the stud holder includes an annular portion concentric to the balance staff and a lug integral with the annular portion and in which is formed the housing for the stud, the housing being oriented parallel to the balance staff.

6. The regulating device according to claim 5, wherein the stud is arranged to simultaneously abut against two distinct areas of the inner wall of the housing when the stud is immobilised, the two areas extending parallel to the balance staff and defining together a wall in the form of a groove, the bottom of the groove being oriented towards the balance staff.

7. The regulating device according to claim 6, wherein the length of the housing is greater than the thickness of the stud holder, one portion of the groove-shaped wall of the housing being formed by a rim projecting from the lower face of the lug.

8. The regulating device according to claim 7, wherein the housing includes an open portion towards the exterior of the balance on the rim projecting from the lower face of the lug.

9. The regulating device according to claim 8, wherein the elastic arm is arranged to bear laterally on the stud on the open portion of the housing.

10. The regulating device according to claim 5, wherein the bearing is mounted in a top balance-endpiece integral with the balance bridge, and wherein the annular portion of the stud holder grips the top balance-endpiece, so that the stud holder is pivoted with a tight fit on the top balance-endpiece.

11. The regulating device according to claim 1, wherein the stud is arranged to simultaneously abut against two distinct areas of the inner wall of the housing when the stud is immobilised, the two areas extending parallel to the balance staff and defining together a wall in the form of a groove, the bottom of the groove being oriented towards the balance staff.

12. The regulating device according to claim 11, wherein the groove is substantially rectilinear and oriented parallel to the balance staff.

13. The regulating device according to claim 1, wherein the stud holder is made of silicon.

14. The regulating device according to claim 1, wherein the stud holder is made of metal.

* * * * *